United States Patent [19]

Oletzke

[11] Patent Number: 4,881,636

[45] Date of Patent: Nov. 21, 1989

[54] FLOATING SEPARABLE KEY CASE

[76] Inventor: G. James Oletzke, 24150 E. Cedar Lake Dr., New Prague, Minn. 56071

[21] Appl. No.: 137,969

[22] Filed: Dec. 28, 1987

[51] Int. Cl.[4] ..... A45C 11/00

[52] U.S. Cl. ..... 206/37.1; 206/37.3; 206/37.4; 206/37.8; D3/61; 70/456 R; 70/457

[58] Field of Search ..... 206/37.1, 37.3, 37.4, 206/37.5, 37.8; D3/61, 65; 70/456 R, 457, 459

[56] References Cited

U.S. PATENT DOCUMENTS

| | | | |
|---|---|---|---|
| D. 203,672 | 2/1966 | Evans | D3/61 |
| 1,110,760 | 9/1914 | Easton . | |
| 1,139,370 | 5/1915 | Putnam . | |
| 1,548,155 | 8/1925 | Milbrad . | |
| 1,996,933 | 4/1935 | Segal | 150/40 |
| 1,999,290 | 4/1935 | Goessling | 150/40 |
| 2,006,707 | 7/1935 | Bashara | 206/37.8 |
| 2,065,940 | 12/1936 | Lane | 150/40 |
| 2,274,820 | 3/1942 | Bills | D3/61 |
| 2,297,285 | 9/1942 | Bledsoe | D3/61 |
| 2,690,666 | 10/1954 | Engle et al. | D3/61 |
| 2,800,941 | 7/1957 | Leddy | 150/40 |
| 3,101,762 | 8/1963 | Bermingham et al. | 150/40 |
| 3,111,152 | 11/1963 | Goessling | D3/61 |
| 3,119,429 | 1/1964 | Stiller et al. | 150/40 |
| 3,292,680 | 12/1966 | Broughton | 150/40 |
| 3,294,137 | 12/1966 | Rubenstein | 206/37.4 |
| 3,529,649 | 9/1970 | Bennett | 150/40 |
| 3,863,477 | 2/1975 | Klein | 206/37.1 |
| 4,581,910 | 4/1986 | Brooks et al. | 70/456 R |

FOREIGN PATENT DOCUMENTS

| | | | |
|---|---|---|---|
| 800492 | 11/1950 | Fed. Rep. of Germany | 206/37.3 |
| 1632538 | 1/1970 | Fed. Rep. of Germany | 206/37.1 |

*Primary Examiner*—David T. Fidei

*Attorney, Agent, or Firm*—William L. Huebsch

[57] ABSTRACT

A key case having first and second generally planar wall portions each including a layer of a flexible material that may have a density substantially less than that of water so that the case will float; key retainers on each of the wall portions affording movement of the key from a position adjacent an inner surface of the wall portion to a position projecting from the wall portion where it can be engaged with a lock; and strip fasteners for releasably attaching the wall portions together around their peripheries with their inner surfaces adjacent and for defining a pocket between the wall portions adapted to receive keys attached to the wall portions. The wall portions are separable to afford use of the keys attached to them in separate locations such as the spaced ignition locks of a yacht or of two snowmobiles.

9 Claims, 1 Drawing Sheet

FLOATING SEPARABLE KEY CASE

TECHNICAL FIELD

The present invention relates to key cases, and in one aspect to such key cases that are adapted to float in water with keys attached to the case.

BACKGROUND ART

The art is replete with key cases of the type adapted to have keys attached to them and to provide compartments in which the keys may be contained and from which one of the keys may be pivoted to afford using that key.

While such key cases are useful for many purposes, they are not as suitable as may be desired for certain applications where keys must be used in different locks at the same time, such as to contain the keys for two snowmobiles or for a yacht of the type requiring two keys to operate separate ignitions systems for separate motors that power the yacht. Typically in such situations one of the keys must be separated from the typical key case or a separate key case must be used for each key to afford starting both motors, which is inconvenient. Additionally, the possibility always exists that the key case or a key separated from it may be dropped into the water and sink so that it would be difficult or impossible to retrieve. While a floating key case as described in U.S. Pat. No. 3,292,680 could help solve the problem of loosing the key case when it is dropped into the water, it still requires that one key of two required to operate two ignition systems must be separated from the case, or that two key cases be used. Also, while separable key rings are known by which two keys can be releasably retained together, no such key rings are known that provide flotation for one or both of the keys.

DISCLOSURE OF INVENTION

The present invention provides a key case particularly useful for containing keys used in separate locks at the same time such as for two snowmobiles or yachts of the type requiring two keys for operating separate and separated ignitions systems for different motors, which key case has separable wall portions, each of which wall portions will float with keys attached to it so that if the case or either wall portion thereof is dropped into the water it will not sink, but will float so that it can be retrieved.

According to the present invention there is provided a floating key case comprising first and second generally planar wall portions each comprising a layer of a soft flexible material having a density substantially less than that of water (e.g., closed cell neoprene foam having brightly colored four way stretch nylon cloth adhered to each of its opposite surfaces of the type used in diving wet suits); key retaining means on each of the wall portions adapted to have a key attached thereto and to afford movement of the key from a position adjacent an inner surface of the wall portion to a position projecting beyond a periphery of the wall portion; and attaching means such as lengths of hook and loop fastener for releasably attaching the wall portions together with their inner surfaces adjacent and for defining adjacent portions of their inner surfaces adapted to receive keys attached by the key retaining means therebetween. The wall portions are separable to afford use of the keys attached to them in separate locations such as in the spaced ignition switches of a yacht or the ignition systems of two snowmobiles.

Preferably the wall portions are elongate and have approximately the same peripheral shape, the attaching means are attached to the inner surfaces along the peripheries to define elongate adjacent portions of the inner surfaces adapted to receive keys attached by the key retaining means therebetween, and the key retaining means, which may comprise eyelets through the wall portions, are attached to opposite ends of the wall portions and may be attached at both ends of at least one of the wall portions.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
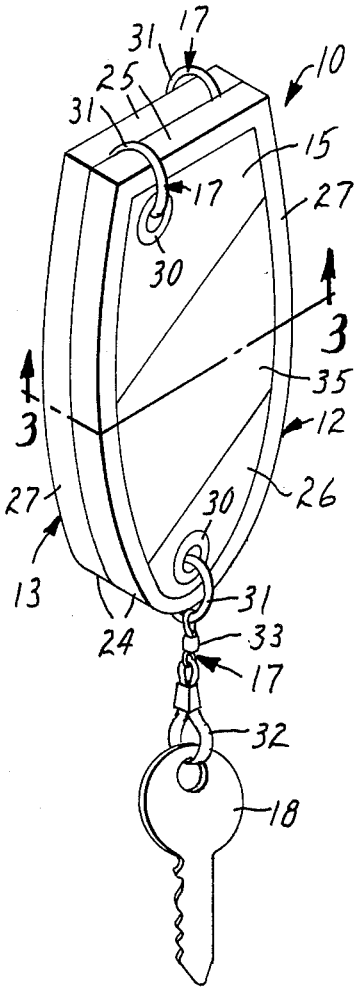
FIG. 1 is a perspective view of a floating separable key case according to the present invention illustrated with a key attached thereto.

Referring now to the drawing, there is shown a floating separable key case according to the present invention generally designated by the reference numeral 10.

Figure 2:
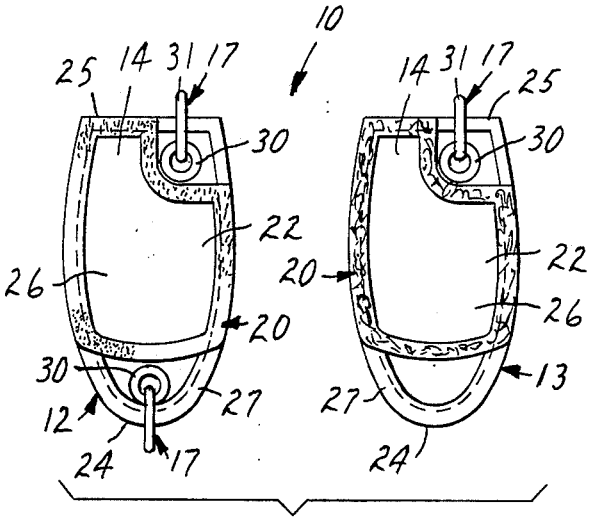
FIG. 2 is a reduced plan view of separated wall portions of the key case of FIG. 1 on which portions of key retaining means are not illustrated.
Figure 3:
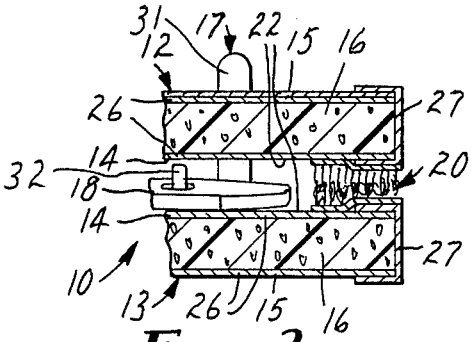
FIG. 3 is an enlarged fragmentary sectional view taken approximately along line 3—3 of FIG. 1.

Generally the key case 10 comprises first and second generally planar wall portions 12 and 13 each having a periphery and inner and outer surfaces 14 and 15. The wall portions 12 and 13 each include a layer 16 (FIG. 3) of a soft flexible material having a density substantially less than that of water (e.g., ¼ inch thick closed cell neoprene foam) key retaining means 17 on each of the wall portions 12 and 13 adapted to have a key 18 attached thereto and to afford movement of the key 18 from a position adjacent the inner surface 14 of the wall portion 12 or 13 to a position projecting beyond the periphery of the wall portion 12 or 13; and attaching means 20 for releasably attaching the wall portions 12 and 13 together with their inner surfaces 14 adjacent and for defining adjacent portions 22 of their inner surfaces 14 adapted to receive keys 18 attached by the key retaining means 17 therebetween. The wall portions 12 and 13 are separable as shown in FIG. 2 to afford use of keys 18 (not shown in FIG. 2) attached thereto by the key retaining means 17 in separate locations such as in separate ignition switches on a yacht or on two different snowmobiles.

Preferably, as illustrated, the wall portions 12 and 13 are elongate, and have approximately the same peripheral shape (e.g., the longitudinal cross sectional shape of a projectile as illustrated) with rounded generally pointed first ends 24 and straight second ends 25 substantially wider than the first ends 24. The attaching means 20 as illustrated are die cut generally annular hook and loop fastener portions attached as by sewing or a suitable adhesive to the inner surfaces 14 of the wall portions 12 and 13 along their peripheries to define the adjacent portions 22 of the inner surfaces 14 that are elongate and thus adapted to receive therebetween keys 18 attached by the key retaining means 17 and to attach the wall portions 12 and 13 together with their first ends 24 and their second ends 25 adjacent. The key retaining means 17 are attached to one of the wall portions 12 at its first end 24 and to the other of the wall portions 13 at its second end 25. Also, preferably, as illustrated, at least the wall portion 12 has key retaining means 17 at both its first end 24 and at its second end 25 so that two keys may be attached to the wall portion 12, with that second retaining means 17 being off center on the same side of its second end 25 as is the key retaining means 17 on the other wall portion 13 so that when the wall portions 12 and 13 are engaged the key retaining means 17 on their second ends 25 will be offset from each other.

The wall portions 12 and 13 preferably each comprise layers 27 of cloth (e.g., four way stretch nylon cloth) adhered to the opposite surfaces of the layer of soft flexible material 16, which layers of cloth define the inner and outer surfaces 14 and 15 of the wall portions 12 and 13 and may be brightly colored to give a finished and aesthetically pleasing appearance to the key case 10. The wall portions 12 and 13 may optionally, as illustrated, also have lengths 27 of bias tape adhered or sewn around their peripheral edges to further finish them.

As illustrated, the key retaining means 17 each comprises an eyelet 30 staked through one of the wall portions 12 or 13, a split ring 31 extending through the opening in the eyelet 30 and around the periphery of the wall portion 12 or 13, and a snap 32 attached by a swivel 33 to the ring 31, which snap 32 is adapted t engage a key 18 through an opening in a head of the key 18.

Also, optionally as illustrated, one or both of the wall portions 12 and 13 may have a fabric strip or label 35 across the outer surface 15 of the wall portion 12 or 13 and attached only at its ends at the periphery of the wall portion 12 or 13. The label 35 may have graphics such as a trade name or advertising printed thereon, and a key 18 attached to the key retaining means 17 may be slipped between the label 35 and the outer surface 15 of the wall portion 12 or 13, which may be useful to contain a key 18 attached to the wall portion 12 or 13 when that wall portion 12 or 13 is separated from the other wall portion 13 or 12 such as when a different key attached thereto is engaged such as in an ignition switch.

Preferably the wall portions 12 and 13 have a shape about as illustrated with a length of about 4 inches, a width of about 2¼ inches and a thickness of about ¼ inch. Key cases with wall portions of this size and of the materials indicated above have been found to float in water while supporting at least three keys.

The present invention has now been described with reference to one embodiment thereof. It will be apparent to those skilled in the art that many changes can be made in the embodiment described without departing from the scope of the present invention. For example, a key case according to the present invention may be quite useful even if its wall portions are made of flexible material that will not float. Thus the scope of the present invention should not be limited to the structure descried in this application, but only by structures described by the language of the claims and the equivalents of those structures.

I claim:

1. A floating key case comprising first and second totally separate generally planar wall portions each having a periphery and inner and outer surfaces, said wall portions each comprising a layer of a soft flexible material having a density substantially less than that of water;

key retaining means on each of said wall portions adapted to have a key attached thereto and to afford movement of the key from a position adjacent the inner surface of said wall portion to a position projecting beyond the peripheral edge of said wall portion; and attaching means for releasably attaching said wall portions together with said inner surfaces adjacent and for defining adjacent portions of said inner surfaces bounded by said attaching means adapted to receive keys attached by said key retaining means between said adjacent portions of said wall portions, said wall portions being totally separable to afford use of the keys attached thereto by said key retaining means in separate locations.

2. A floating key case according to claim 1 wherein said wall portions have approximately the same peripheral shape and said attaching means are attached to said inner surfaces along said peripheries.

3. A floating key case according to claim 1 wherein said layer of soft flexible material is closed cell neoprene, and said wall portions each further comprise layers of four way stretch nylon adhered to opposite surfaces of said layer of soft flexible material to define said inner and outer surfaces.

4. A floating key case according to claim 1 wherein said wall portions are elongate, have first and second ends, and have approximately the same peripheral shape, said attaching means are attached to said inner surfaces along said peripheries to define elongate adjacent portions of said inner sirfaces adapted to receive keys attached by said key retaining means therebetween and attach said wall portions with said first ends adjacent, said key retaining means on one of said wall portions is attached at said first end, and said key retaining means on the other one said wall portions is attached at said second end.

5. A floating key case according to claim 4 wherein said key retaining means each comprise an eyelet through one of said wall portions and a ring through said eyelet.

6. A floating key case according to claim 4 wherein at least one of said wall portion has key retaining means at both its first end and at its second end.

7. A floating key case according to claim 1 wherein said attaching means comprises strips of hook and loop fastener portions attached to the inner surfaces of said wall portions.

8. A floating key case according to claim 1 wherein said key case includes a strip of material across the outer surface of one of said wall portions and attached at its ends at the periphery of the wall portion.

9. A floating key case according to claim 2 wherein said wall portions have a length of about 4 inches, a width of about 2¼ inches, and a peripheral shape similar to the longitudinal cross sectional shape of a projectile.

* * * * *